US005088880A

United States Patent [19]

Field, Jr.

[11] Patent Number: 5,088,880

[45] Date of Patent: Feb. 18, 1992

[54] FLUID OPERATED FORK POSITIONING CONTROL SYSTEM

[75] Inventor: Jesse L. Field, Jr., Concord, Ohio

[73] Assignee: Caterpillar Industrial Inc., Mentor, Ohio

[21] Appl. No.: 621,493

[22] Filed: Dec. 3, 1990

[51] Int. Cl.[5] ..... B66F 9/12

[52] U.S. Cl. ..... 414/667

[58] Field of Search ..... 414/659, 662, 664, 667, 414/668, 670, 671; 91/508, 521, 531; 60/484

[56] References Cited

U.S. PATENT DOCUMENTS

| | | | |
|---|---|---|---|
| 2,920,775 | 1/1960 | Schenkelberger | 414/667 |
| 3,166,207 | 1/1965 | Quayle | 414/667 |
| 3,179,274 | 4/1965 | Comfort | 414/667 |
| 3,180,514 | 4/1965 | Horton | 414/620 |
| 3,184,088 | 5/1965 | Berge | 414/667 |
| 3,395,732 | 8/1968 | Comfort | 414/620 |
| 3,738,520 | 6/1973 | Didtel et al. | 414/667 |
| 3,831,795 | 8/1974 | Kawanishi et al. | 414/667 |
| 4,086,843 | 5/1978 | Lorimor | 91/412 |
| 4,325,464 | 4/1982 | larsson | 187/9 E |
| 4,335,992 | 6/1982 | Reeves | 414/667 |
| 4,392,773 | 7/1983 | Johannson | 414/667 |
| 4,487,106 | 12/1984 | Field, Jr. | 91/436 |
| 4,523,886 | 6/1985 | Reeves | 414/667 |

FOREIGN PATENT DOCUMENTS

| | | | |
|---|---|---|---|
| 2726147 | 12/1978 | Fed. Rep. of Germany | 414/667 |
| 1279945 | 12/1986 | U.S.S.R. | 414/662 |

*Primary Examiner*—Jesus D. Sotelo
*Assistant Examiner*—Stephen P. Avila
*Attorney, Agent, or Firm*—Alan J. Hickman

[57] ABSTRACT

A control system for selectively moving load engaging forks along a carriage frame in first and second modes of operation is provided. In the first mode of operation the first and second forks are movable in unison and at the same rate of speed along the carriage frame and in the second mode of operation the forks are individually selectively movable. The control system includes a main control valve and first, second, and third selector valves for directing fluid flow delivered by the main control valve to first and second fluid operated jacks connected to the first and second forks, respectively, and the carriage frame. The third selector valve directs fluid flow between head ends of the jacks in the first mode of operation so that the first and second forks move in unison on the carriage frame. The control system is particularly suited for use on a material handling vehicle having a lift mast assembly.

24 Claims, 3 Drawing Sheets

FLUID OPERATED FORK POSITIONING CONTROL SYSTEM

DESCRIPTION

1. Technical Field

This invention relates to a control system for transversely moving a pair of load engaging forks and more particularly to a lift mast assembly having a control system which facilitates both independent transverse fork spacing movement and a side shift of the forks in unison.

2. Background Art

Hydraulic control systems for independently positioning the forks on the carriage of a lift mast assembly have been utilized for many years. Typically, such fork positioning control system utilize a pair of manually actuatable control valves which direct hydraulic fluid to the head and rod ends of either or both of the first and second jacks so that the forks may be moved transversely along the carriage to a desired spaced location relative to each other. A system such as this is satisfactory for providing the proper spacing between the forks so that a load may be engaged by the forks when the vehicle is properly positioned relative to the load.

In many of the load handling applications, it is desirable to be able to side shift the carriage assembly so that the carriage assembly upon which the forks are mounted may be positioned to engage the load to be lifted. Side shiftable carriages have a carriage support frame which is elevationally movable along the uprights of the lift mast assembly and a side shiftable frame mounted on the carriage support frame. The pair of load engaging forks are mounted on the side shiftable frame and move with the side shiftable frame in order that the forks may be aligned to engage the load. The side shiftable frame is typically moved by a single fluid operated jack which is connected to and between the side shift frame and the support frame. Although such a system provides side shifting of the carriage for alignment purposes with the load, it does not permit independent fork adjustments.

The addition of a side shiftable frame on a carriage support frame causes a reduction in the load carrying capacity of the vehicle upon which the lift mast assembly is mounted. This reduction in load carrying capacity is due to the increase in distance from the center of gravity of the vehicle to the load carrying forks. The side shiftable frame is normally hung on the carriage support frame and extends in front of the carriage support frame which results in the increased distance from the center of gravity of the vehicle. The reduction in the load carrying capacity of the lift truck can be compensated by adding an additional weight to the counterweight of the vehicle. However, such an increase in weight affects the size and strength of the vehicle which reduces the overall efficiency of operation of the lift truck as well as the vehicle cost and durability. Attempts have been made to solve this problem, however, the addition of the side shift frame on the support frame has prevented a total satisfactory solution.

Having the ability to side shift is extremely important in applications where maneuverability of the vehicle is difficult and the position of the carriage relative to the load to be lifted or the position of the carriage relative to the deposit location is critical. The side shiftable frame enables the vehicle operator to be less accurate with vehicle maneuvering and thus increases the efficiency and thruput of the load handling operation. However, lift trucks frequently are not equipped with side shiftable carriages because of increased cost, complexity of component design, and reduced load carrying capacity.

Large load lifting capacity lift trucks often have forks which weigh several hundred pounds. In order for such forks to be properly positioned relative to each other on the carriage assembly, a pair of hydraulic jacks are usually employed to provide motive power to move the forks. Because the jacks are infrequently used, the cost often outweighs the utility. Thus, many lift truck owners devise other ways to position the forks which often causes damage to the lift mast assembly including the carriage and associated componentry. One way used to transversely move the fork(s) is to force the fork against a rigid object by maneuvering the vehicle.

Transversely adjustable forks have been provided on a side shiftable carriage frame. Each of the fork adjustment functions and the carriage side shifting function require an independent control valve, a control lever and a complex network of hoses and conduits. The complexity of such a system makes it difficult to operate and the additional cost outweighs the benefits to be gained.

The present invention is directed to overcoming one or more of the problems as set forth above.

DISCLOSURE OF THE INVENTION

In one aspect of the present invention, a control system for selectively moving first and second load engaging forks along a carriage frame is provided. First and second fluid operated jacks are connected to the carriage frame and first and second load engaging forks, respectively. The first and second fluid operated jacks each have a head and rod end portion and are adapted to move the first and second load engaging forks along the carriage frame. A source of pressurized fluid flow is connected to a reservoir. A main control valve is provided for selectively directing pressurized fluid flow from the fluid source to the first and second jacks and exhausted fluid flow from the first and second jacks to the reservoir. A selector valve arrangement is provided for directing fluid flow delivered from the main control valve to one of the head and rod end portions of one of the first and second jacks, for directing exhausted fluid flow from the other end portion of the one jack to a same one of the head and rod end portions of the other of the first and second jacks, and for directing exhausted fluid flow from an other end portion of the other jack to the main control valve. The first and second jacks move the first and second forks at equal rates of speed along the carriage frame in the same direction in response to the one jack receiving delivered fluid flow from the main control valve and the other jack receiving exhausted fluid flow from the one jack.

In another aspect of the present invention, a lift mast assembly having a pair of spaced apart uprights and a carriage assembly mounted on the pair of spaced apart uprights in elevationally movable along the uprights is provided. The carriage assembly has a carriage frame and first and second forks slidably connected to the carriage frame and movable in directions transverse the pair of uprights. The carriage frame is movably connected to the pair of uprights and elevationally movable along the uprights. First and second fluid operated jacks each having a housing, an extensible piston rod assembly, and head and rod end portions are provided. The first jack is connected to and between the first fork and the carriage frame and the second jack is connected to and between the second fork and the carriage frame. The first and second forks are transversely movable along the carriage frame in response to extension and retraction of the piston rod assembly. A source of pressurized fluid flow is connected to the reservoir and a valve arrangement. The valve arrangement is provided for directing fluid flow from the fluid source to a selected one of the rod and head end portions of one of the first and second jacks, for directing exhausted fluid flow from the other end portion of the selected one jack to the same one of the rod and head end portions of the other jack, and for directing fluid flow from the other end portion of the other jack to the reservoir in response to being in a first mode of operation. The valve arrangement is also provided for directing fluid flow from the source of pressurized fluid flow to one of the rod and head end portions of a selected one of the first and second jacks and from the other end portion of the selected one of the first and second jacks to the reservoir in response to being at a second mode of operation. A control device is connected to the valve arrangement and enables selection of one of the first and second modes of operation.

The control system enables a pair of forks to be moved independently of each other or in unison so that fork spacing adjustment and carriage side shift positioning are achieved without providing an independent side shiftable carriage assembly. Thus, the load moment constant is kept at a minimum as the carriage assembly does not require a side shift frame to be added to the support frame of the carriage.

The control system achieves both the side shift and fork adjust functions in a simple, efficient and low cost manner and without requiring the addition of complicated and costly carriage structure.

A single, manually controlled lever and switch arrangement provides for ease of control of the side shift and fork adjust functions. Thus the cost and complexity of operation is further reduced.

BEST MODE FOR CARRYING OUT THE INVENTION

Figure 1:
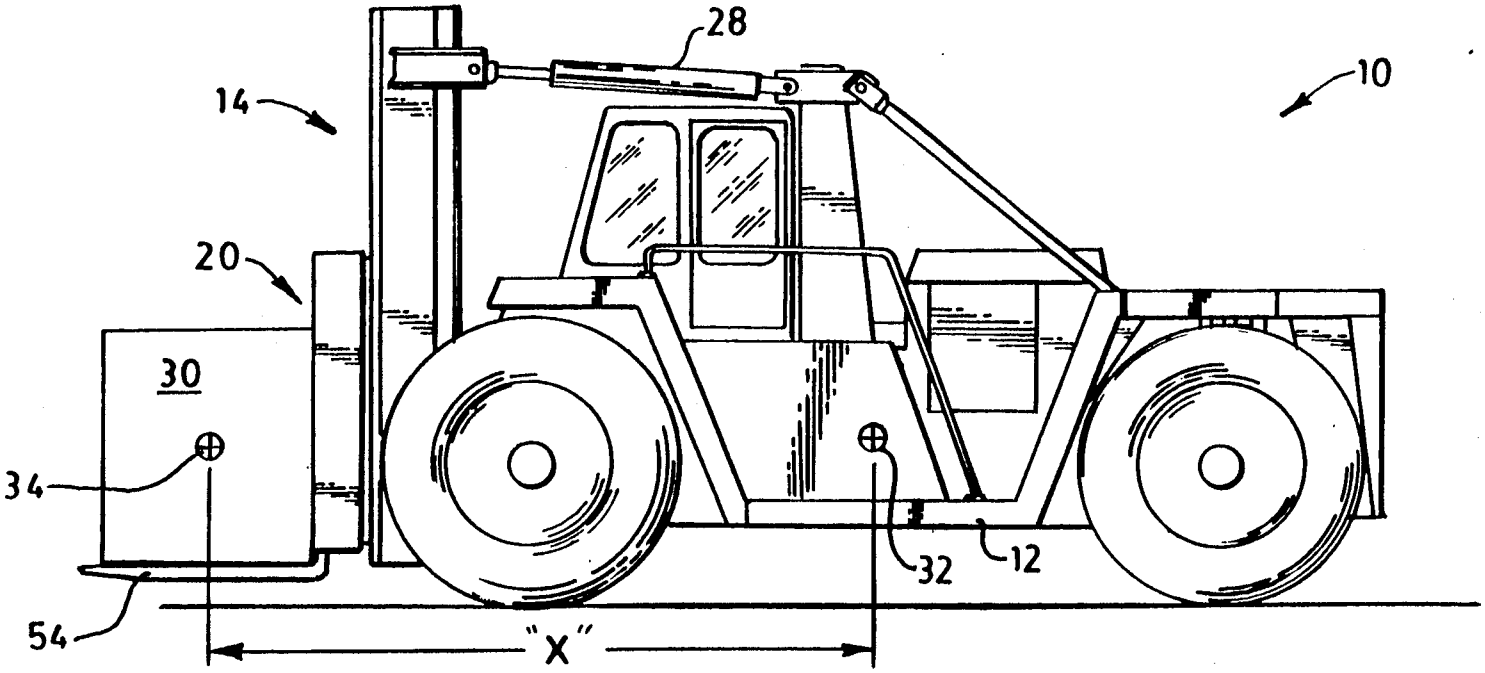
FIG. 1 is a diagrammatic side elevational view of an embodiment of the present invention showing a material handling vehicle with a lift mast assembly mounted on one end of the vehicle.
Figure 2:
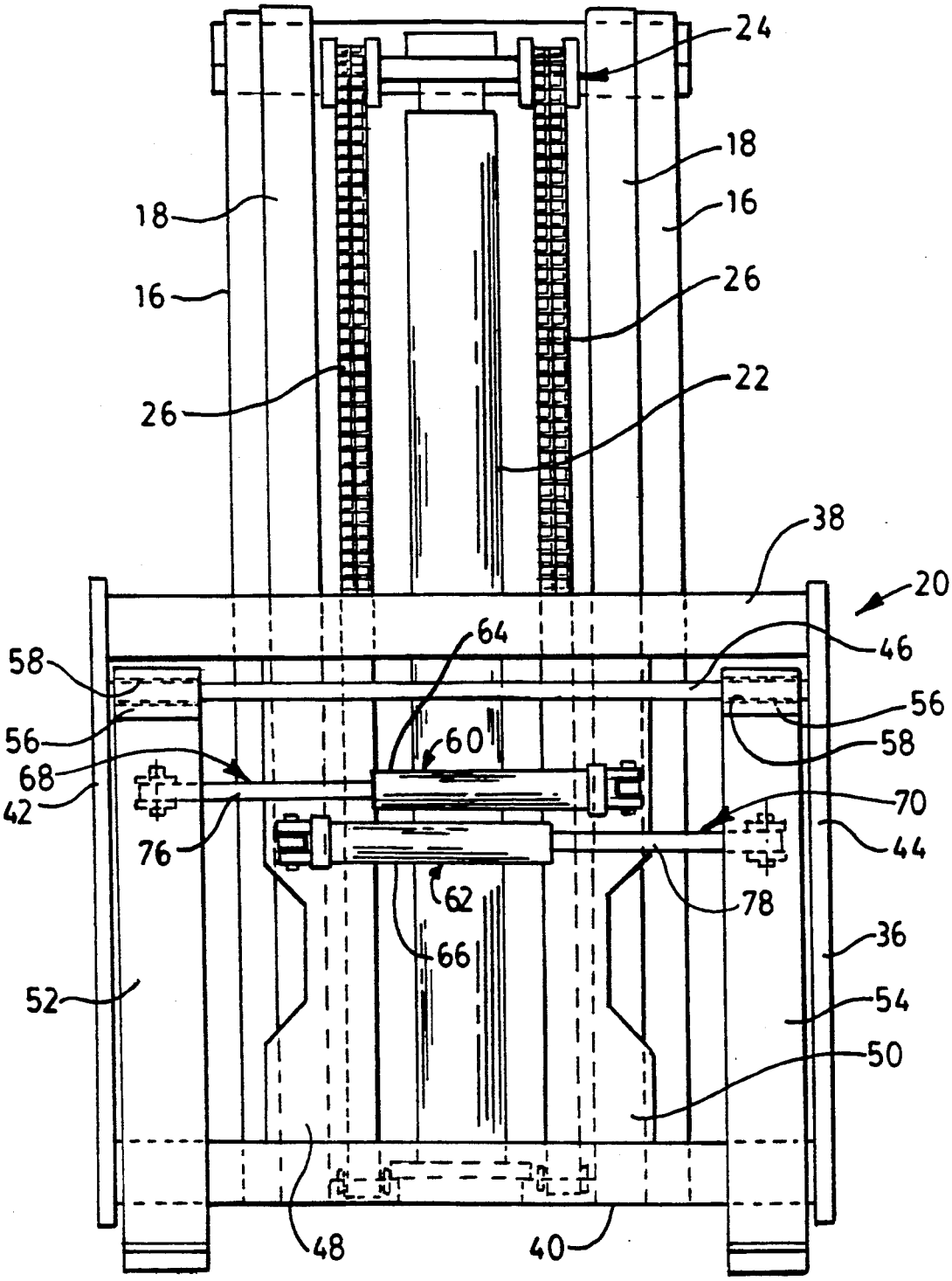
FIG. 2 is a diagrammatic front elevational view of the lift mast assembly of FIG. 1 showing the carriage assembly and side shiftable and adjustable forks in some detail.

With reference to the drawings, and particularly FIGS. 1 and 2, a material handling vehicle 10 having a frame 12 and a lift mast assembly 14 mounted on the frame is generally shown. The lift mast assembly 14 has first and second pairs of spaced apart uprights 16,18 and a carriage assembly 20. The carriage assembly 20 is connected to the second pair of uprights 18 in a conventional fashion such as by a guide roller assembly and elevationally movable along the second pair of uprights 18 between elevationally spaced apart locations. The second pair of uprights 18 is disposed in a nested relationship relative to the first pair of uprights 16 and elevationally movable relative to the first pair of uprights 16. A lift jack 22 and chain reeving arrangement 24 provide for elevational movement of the second pair of uprights 18 and the carriage assembly 20. The lift jack assembly 22 is connected at opposite ends to the first and second pairs of uprights 16,18, respectively and causes extensible movement of the second pair of uprights 18 relative to the first pair of uprights 16. The chain reeving assembly 24 is mounted on the lift jack 22 at one end thereof and moves with extension of the lift jack 22. The chains 26 are connected at opposite ends thereof to and between the carriage assembly and the first pair of uprights 16 so that a 2 to 1 relationship between the speed of movement of the carriage assembly 20 and the extension of the second pair of movable uprights 18 is provided. Lift mast assemblies of this type are well known in the art. Therefore, no further discussion concerning elevational movement will be provided.

The lift mast assembly 14 and particularly the first pair of uprights 16 are pivotally connected to the front end portion of the material handling vehicle 10 in any conventional manner and pivotable about the pivotable connection by tilt jacks (only one shown) 28. The tilt jacks 28 are selectively controllable in any well known manner so that the carriage assembly 20 may be positioned to pick up or deposit a load 30. The material handling vehicle 12 has a load moment center 32 which is spaced from the center of gravity 34 of the load 30. The distance "X" between the load moment center 32 and the center of gravity of the load 30 determines the load lifting capacity of the vehicle 10 for a given vehicle weight. That is, the greater the magnitude of distance "X" the smaller the load carrying capacity of the vehicle. Therefore, it is important to minimize the distance "X" so that the weight of the load may be maximized.

The carriage assembly 20 has a carriage frame 36 which consists of first and second spaced apart substantially parallel beams 38,40, first and second substantially parallel spaced apart side members 42,44, and a fork support shaft 46. The first and second side members 42,44 are connected to opposite ends of the first and second beams and form a substantially rectangular shaped frame 20. The fork support shaft 46 is connected at its opposite ends to the first and second side members 42,44 and is substantially parallel to the first beam 38. The carriage assembly has first and second substantially parallel spaced apart brackets 48,50 which are connected at opposite ends thereof to the first and second beams 38,40 at a location between the first and second side members 42,44.

First and second brackets 48,50 provide additional stiffness to the carriage frame 36 and are connected to the aforementioned roller bracket assembly (not shown).

First and second forks 52,54 which have an L-shaped configuration are slidably connected at one end portion thereof to the fork support shaft 46. Specifically, the forks each have an aperture 58 which is disposed therethrough for receiving the shaft 46 therein. Clearance is provided between the diameter of the shaft 46 and the aperture 58 so that the forks are freely slidable along the shaft 46. Although not shown, the shaft 46 is removably connected to the carriage so that the forks 52,54 may be installed upon the shaft 46. The carriage frame 36 is a rigid structure and is only movable in an elevational direction along the second pair of uprights 18. The only other movement provided is transverse movement of the forks along the shaft 46 and transverse the first and second pairs of uprights 16,18. Due to the absence of an additional side shiftable frame mounted on the carriage frame 36, the distance "X" is maintained at a minimum and therefore the load carrying capacity of the material handling vehicle 10 is maximized.

It is to be noted that the specific type of carriage assembly 20 disclosed herein is referred to as a shaft type carriage because shaft 46 connects the forks 52,54 to the carriage frame 36. Another type of carriage assembly suitable for use herein is a hook type carriage assembly in which the forks 52,54 have a hook like structure at the upper end portion thereof and are hung on the top edge of the carriage frame 36 and do not require a shaft 46. It should be appreciated that either type of carriage assembly is well known in the art and considered within the scope of this invention.

Figure 3:
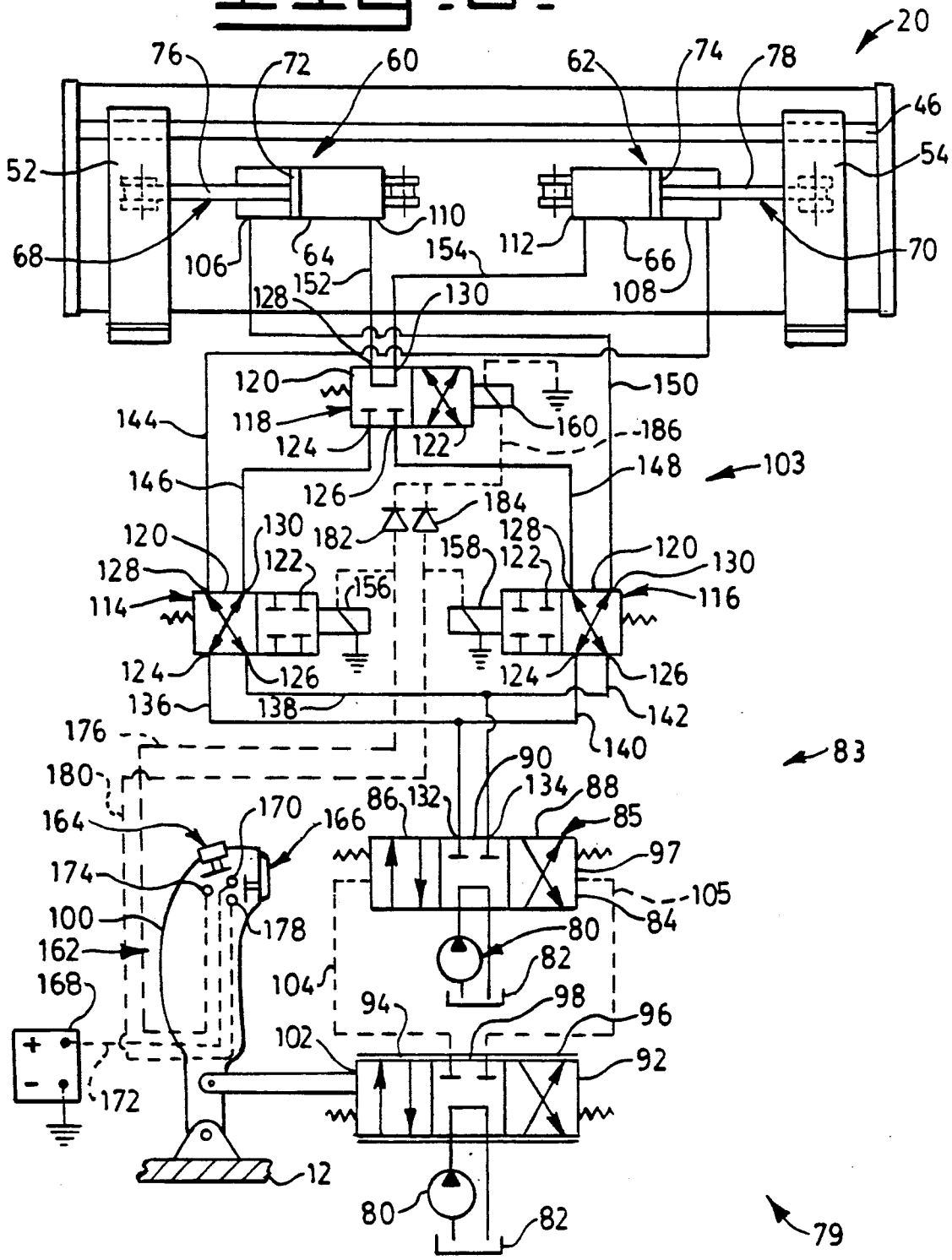
FIG. 3 is a diagrammatic schematic representation of the fluid operated control system for controlling the position and movement of the forks.

Referring to FIGS. 2 and 3 the carriage assembly 20 has first and second jacks 60,62 which are connected to and between the frame 36 of the carriage assembly 20 and the first and second forks 52,54, respectively. Specifically, the first and second jacks 60,62 each have a cylinder housing 64,66, a piston rod assembly 68,70 slidably disposed in the respective housing 64,66 and movable in response to pressurized fluid flow being applied to the respective pistons 72,74. The pistons 72,74 each have a predetermined diameter of substantially equal magnitude and the rods 76,78 each have a diameter of substantially equal magnitude in order to obtain equal and synchronized jack movement so that side shift of the forks 52,54 along the carriage frame 36 in unison may be achieved without the need for a separate and additional side shiftable carriage frame. The rods 76,78 of the first and second piston rod assembly 68,70 are pivotally connected to the first and second forks 52,54, respectively. Similarly the first and second housings 64,66 are pivotally connected to the first and second brackets 48,50, respectively. The first and second jacks are of a length suitable to permit the first and second forks 52,54 to be moved to substantially a full out position as shown in FIG. 2, or to substantially a full in position at which the forks are located near a vertical plane bisecting the length of the first and second beams 38,40.

The connections for the first and second jacks to the first and second forks 52,54 and the first and second brackets 48,50 is achieved in any suitable manner, such as, by a conventional clevis and pin arrangement. In situations where a larger degree of misalignment and jack movement is anticipated a spherical ball and seat joint is also provided at the connections. Connections of this type allow the first and second jacks 60,62 to pivotally move under loaded movement of the fork so that side loading of the jacks 60,62 is prevented.

The first and second jacks 60,62 are double acting jacks and therefore the first and second forks 52,54 are movable along the fork support shaft 46 in directions of extension of retraction of the first and second piston rod assemblies 68,70, respectively.

With reference to FIG. 3, a control system 79 for selectively moving the first and second load engaging forks 52,54 along the fork support shaft 46 of the carriage frame 36 is provided. The control system includes a source of pressurized fluid flow 80 which includes a reservoir 82.

A valve means 83 is provided for directing fluid flow from the fluid source 80 to one of the rod and head end portions 106,108,110,112 of one of the first and second jacks 60,62, for directing exhausted fluid flow from the other end portion 106,108,110,112 of the one jack 60,62 to the same one of the rod and head end portions, 106,108,110,112 of the other jack 60,62, and for directing fluid flow from the other end portion 106,108,110,112 of the other jack 60,62 to the reservoir 82 in response to being in a first mode of operation. The valve means 83 also provides for the directing fluid flow from the source 80 of pressurized fluid flow to one of the rod and head end portions 106,108,110,112 of a selected one of the first and second jacks 60,62 and from the other end portion 106,108,110,112 of said selected one jack 60,62 to the reservoir 82 in response to being in a second mode of operation.

The valve means 83 includes a main control valve means 85. The main control valve means 85 preferably includes a main control valve 84. The main control valve 84 is a 3-position 4-way valve which is pilot operated and movable between first and second positions 86,88 and a neutral position 90. The valve means 83 also includes a pilot valve 92 which is preferably a 3-position 4-way valve having first and second positions 94,96 and a neutral position 98. The pilot valve 92 is manually shiftable between the neutral position 98 and the first and second positions 94,96 via a control lever 100. Preferably the control lever 100 is pivotally connected to the vehicle frame 12 in any suitable manner and connected to a valve spool 102 of the pilot valve 92 in any suitable manner. The pilot valve 92 is connected to the main control valve 84 via conduits 104,105 and delivers pressurized fluid flow from the source 80 to one end of the main control valve 84 via conduit 104 at the first position 94 and delivers pressurized fluid flow from the pump 80 to another end of the pilot valve 92 via conduit 105 at the second position 96. A spool 97 of the main control valve 84 shifts to the first position 86 in response to the pilot valve 92 being at the first position 94 and shifts to the second position 88 in response to the pilot valve 92 being at the second position 96. Both the main control valve 84 and pilot valve 92 pass fluid flow from the source 80 to the reservoir 82 at their respective neutral positions 90,98. Fluids in conduits 136,138,140,142 is blocked at the main control valve 84 at the neutral position of the main control valve 84, and fluid in conduits 104,105 is blocked at the pilot valve 92 at the neutral position of the pilot valve 92. It is to be noted that the source of pressurized fluid flow 80 is shown in FIG. 3 as a pair of fixed displacement pumps, however, a single pump may be provided to supply fluid flow to the main control valve 84 and the pilot valve 92.

The main control valve 84 is provided for directing pressurized fluid flow from the fluid source 80 to the first and second jacks 62,64 and exhausted fluid flow from the first and second jacks 62,64 to the reservoir 82. The main control valve 84 and the pilot valve 94 are normally biased to their neutral positions.

The valve means 83 further includes a selector valve means 103 for selectively directing fluid flow delivered from the main control valve 84 to one of the head and rod end portions 106,108,110,112 of one of the first and second jacks 60,62. The selector valve means 103 also directs exhausted fluid flow from the other end portion 106,108,110,112 of the one jack 60,62 to the same one of the head and rod end portions 106,108,110,112 of the other of the first and second jacks 60,62, and the exhausted fluid flow from the other end portion 106,108,110,112 of the other jack 60,62 to the main control valve 84. The first and second jacks 60,62 move the first and second forks 52,54 at equal rates of speed along the carriage frame 36 and in the same selected direction in response to the one jack 60,62 receiving delivered fluid flow from the main control valve 84 and the other jack 60,62 receiving exhausted fluid flow from the one jack 60,62.

Preferably the selector valve means 103 is provided for directing fluid flow, directed from the fluid source 80 by the main control valve 84, to the rod end portion 106,108 of one of the first and second jacks 60,62, for directing exhausted fluid flow from the head end portion 110,112 of the one jack 106,108 to the head end portion 110,112 of the other of said first and second jacks 60,62 and for directing fluid flow from the rod end portion 106,108 of the other jack 60,62 to the reservoir 82 in response to being in a first mode of operation. The selector valve means 103 also directs fluid flow from the fluid source 80 to the rod end portion 106,108 of a selected one of the first and second jacks 60,62 and from the head end portion of the selected one jack 60,62 to the reservoir in response to being in a second mode of operation.

Specifically, the selector valve means 103 includes first, second, and third selector valves 114,116,118 connected to and between the main control valve 84 and the jacks 60,62. Specifically, the first, second, and third selector valves 114,116,118 are 2-position 4-way electro-hydraulic valves which are spring biased to a first position 120. The first and second selector valves 114,116 pass fluid flow delivered from the main control valve 84 at the first position of the first and second selector valves 114,116, and block fluid flow delivered from the main control valve 84 to the first and second selector valves 114,116 at the second position of the first and second selector valves 114,116. The third selector valve 118 passes fluid flow delivered from either of the first and second selector valves 114,116 at the second position 122 of the third selector valve 118 and blocks fluid flow delivered from either of the first and second selector valves 114,116 at the first position 120 of the third selector valve 118. The first, second, and third selector valves 114,116,118 are each spring biased to their first position 120.

The first, second, and third selector valves 114,116,118 have first and second inlet ports 124,126 and first and second outlet ports 128,130. The first and second inlet ports 124,126 of the first selector valve 114 is connected to the first and second outlet ports 132,134 of the main control valve 84 via conduits 136,138. In a like manner the first and second inlet ports 124,126 of the second selector valve 116 are connected to the first and second outlet ports 132,134 of the main control valve 84 by conduits 140,142. The first outlet port 128 of the first selector valve is connected to the rod end 108 of the second jack 62 by conduit 144 and the second outlet port 130 of the first selector valve 114 is connected to the first inlet port 124 of the third selector valve 118 by conduit 146. The first outlet port 128 of the second selector valve 116 is connected to the second inlet port 126 of the third selector valve 118 by conduit 148 and the second outlet port 130 of the second selector valve 116 is connected to the rod end 106 of the first jack 60 by conduit 150. The first outlet port 128 of the third selector valve 118 is connected to the head end 110 of the first jack 60 by conduit 152 and the second outlet port 130 of the third selector valve 118 is connected to the head end 112 of the second jack 62 by conduit 154. The first selector valve passes fluid flow between conduits 136 and 146 and between conduits 138 and 144 at the first position 120 and blocks fluid from flowing through the first selector valve 114 at the second position 122. The second selector valve 116, at the first position thereof, passes fluid flow between conduit 140 and 150 and between conduit 142 and conduit 148, and at the second position thereof, blocks fluid flow from passing through the second selector valve 116. The third selector valve 118 at the second position 122 thereof passes fluid flow between conduits 148 and 152 and between conduits 146 and 154, and at the first position passes fluid flow between conduits 152 and 154 and blocks fluid flow at conduits 146 and 148. The first, second, and third selector valves 114,116,118 are preferably movable from the first position to the second position by first, second, and third solenoids 156,158,160, respectively. It is to be noted that any electrically actuated apparatus suitable for shifting the selector valves 114,116,118 is Within the scope of the invention.

Control means 162 is provided for selecting one of the first and second modes of operation. The control means selectively actuates the main control valve 84 and the selector valve means 103. The control means 162 includes first and second switches 164,166 and the control lever 100. The first and second switches are preferably mounted on the control lever and operatively connected between a source of electrical energy 168 and the solenoids 156,158,160 of the selector valves 114,116,118. Preferably, the source 168 is connected to a terminal 170 of the first and second switches 164,166 by conductor 172. A first conductor is connected to and between a terminal 174 of the first switch 164 and the solenoid 156 of the first selector valve 114 and a second conductor 180 is connected between a terminal 178 of the second switch 166 and the second solenoid 158. First and second diodes 182,184 are connected to the first and second conductors 176,180, respectively, and to the third solenoid 160 by branch conduit 186. The first diode 182 prevents actuation of the first solenoid 156 when the second switch 166 is closed (engaging terminals 170,178) and the second diode 184 prevents actuation of the second solenoid 158 when the first switch 164 is closed (engaging the terminals 170,174). The first and second diodes 182,184 are arranged to pass electrical energy to third solenoid 160 when either the first or second switches 164,166 are closed. The first and second switches 164,166 are normally open and actuated to a closed position by depression of the vehicle operator.

As can be seen from a cursory review of FIG. 3 the selector valves 114,116,118 are normally biased to the first position 120 and moved to the second position in response to actuation of the associated solenoid 156,158,160. The valve means 83 and particularly the first, second, and third selector valves 114,116,118 are normally in the first mode of operation (as shown in FIG. 3) and actuatable to place the valve means 83 in the second mode of operation when either of the first and second switches 164,166 are in the closed position. Therefore, in the first mode of operation side shifting (movement in unison, in the same direction and at the same speed) of the first and second forks 52,54 is achieved through the passing of fluid flow between the head ends 110,112 or the first and second jacks 60,62. In the second mode of operation individual control of the first and second jacks 60,62 is achieved by simply depressing the desired one of the first and second switches 164,166 so that either of the first and second forks 52,54 may be moved so that the proper spacing of the forks may be obtained.

INDUSTRIAL APPLICABILITY

With reference to the drawings, and particularly FIG. 3, the operator of the material handling vehicle 10 has the option of selecting either the first or second modes of operation by simply moving the lever 100 or depressing a desired one of the first and second switches 164,166. That is, the operator has the option of moving the first and second forks 52,54 so that the proper fork spacing may be obtained, or side shifting the forks 52,54 in unison to provide the same function as a separate side shiftable carriage.

To individually move the first fork 52 the operator would close switch 164 by depression thereof and pivot the lever 100 to control the position of the main control valve 84. By closing switch 164 the first and third selector valves 114,118 are moved to the second positions 122, respectively. Because the fluid in conduits 136 and 138 are blocked at the second position 122 of the first selector valve 114, fluid flow delivered from the source 80 is directed by the main control valve 84 through the second selector valve 116 and through the third selector valve 118 to the first jack 60 and the exhausted fluid from either the rod or head end 106,110 of the first jack 60 is directed by the third selector valve 118 and the second selector valve 116 to the main control valve 84 and ultimately to the reservoir 82. By this action, the operator can place the first fork 52 at any desired location along the fork support shaft 46 desired. It is to be noted that the direction of pivoting of the control lever 100 determines the direction of fluid flow in conduits 140 and 142 and the direction of movement of the rod assembly 68 of the first jack 60.

In a similar manner to adjust the position of the second fork 54 along the fork support shaft 46 the operator simply depresses the second switch 166 and pivots the control lever 100 in the desired direction. This pivoting action controls the direction of fluid flow in conduits 136 and 138 and the closure of switch 166 causes the second and third selector valves to move to their second position 122 and thereby force fluid flow delivered from the source 80 through a selected one of conduits 136 and 138 through the first and third selector valves 114,116 and to the rod or head end 108,112 of the second jack 62. The direction of pivotal movement of the control lever determines the direction of movement of the second fork 54 by controlling the passage of flow to either conduits 136 or 138. Because the pilot and main control valves 92,84 are infinitely variable, not only is the direction of fluid selected but also the amount of fluid flow. Therefore, the rate of movement of the forks can be carefully and precisely controlled so that accurate positioning is possible.

The first, second, and third selector valves 114,116,118 are not infinitely variable and therefore may be of a simple low cost construction which makes the control system 79 desirable for use.

To obtain true side shift of the first and second forks 52,54 it is necessary that the first and second forks move in the same direction and at the same rate of speed along the fork support shaft 46. The control system 79 enables side shift of the forks 52,54 to replace a side shift carriage by moving the forks in the same direction and at the same speed. This is accomplished by simply moving the control lever 100 in the desired direction of movement of the forks 52,54. By shifting the pilot valve 92 to the first position 94 the main control valve 84 is moved to the first position 86 which forces fluid flow through conduit 140 through the second selector valve 116 and through conduit 150 to the rod end 106 of the first jack 60. The force of the fluid acting on the piston 72 moves a first rod 76 and the fork 52 attached thereto to the right. The fluid in the head end 110 of the first jack 60 is exhausted therefrom through conduit 152 and directed by the third selector valve through conduit 154 to the head end 112 of the second jack 62. The fluid entering the head end 112 forces the second piston 74 to move the second rod 78 and the second fork 54 attached thereto to the right. Fluid in the rod end 108 of the second jack 62 is exhausted therefrom through conduit 144, through the first selector valve, and conduit 138 to the main control valve 88. Because the main control valve was at the first position 86, fluid flow is passed through the main control 84 and to the reservoir 82.

To shift the forks in unison to the left as viewed in FIG. 3, the operator simply moves the control lever 100 to the left which would result in shifting of the main control valve 84 to the second position 88 and reverse the direction of flow opposite to that as previously discussed.

As one can see from this discussion, the control system enables true fork side shifting and individual fork adjustment without requiring the addition of a separate carriage assembly or additional expensive componentry. Also, the elimination of a side shiftable carriage reduces the load moment acting on the vehicle and enables the size and weight of the load to be carried to be maintained at a maximum.

Other aspects, objects, and advantages of the present invention can be obtained from a study of the drawings, the disclosure, and the appended claims.

I claim:

1. A control system for selectively moving first and second load engaging forks along a carriage frame, comprising:

a first fluid operated jack connected to the first load engaging fork and the carriage frame;

a second fluid operated jack connected to the second load engaging fork and the carriage frame, said first and second fluid operated jacks each having head and rod end portions and being adapted to move the first and second load engaging forks respectively, along the carriage frame;

a reservoir;

a source of pressurized fluid flow connected to said reservoir;

a main control valve having first and second positions and being movable between said first and second positions, said main control valve having first and second outlets and being connected to the source of pressurized fluid flow and said reservoir, said main control valve connecting the source to the first outlet and the reservoir to the second outlet at the first position, and the reservoir to the first outlet and the source to the second outlet at the second position;

a first selector valve having first and second positions and being movable between said first and second positions, said first selector valve having first and second inlets and first and second outlets, said first selector valve first inlet being connected to the first selector valve second outlet and said first selector valve second inlet being connected to the first selector valve first outlet at the first position of the first selector valve, said first and second inlets and outlets of the first selector valve being blocked from each other at the second position of the first selector valve;

a second selector valve having first and second positions and being movable between said first and second positions, said second selector valve having first and second inlets and first and second outlets, said second selector valve first inlet being connected to the first selector valve second outlet and said second selector valve second inlet being connected to the second selector valve first outlet at the first position of the second selector valve, said first and second inlets and outlets of the second selector valve being blocked from each other at the second position of the second selector valve;

a third selector valve having first and second positions and being movable between said first and second positions, said third selector valve having first and second inlets and first and second outlets, said third selector valve first and second inlets being blocked from the third selector valve first and second outlets at the first position of the third selector valve, said the third selector valve first and second outlets being connected to each other at the first position of the third selector valve, and said third selector valve first inlet being connected to the third selector valve second outlet and said third selector valve second inlet being connected to the third selector valve first outlet at the second position of the third selector valve;

means for connecting the first outlet of the main control valve to the first inlet of the first and second selector valves, the second outlet of the main control valve to the second inlet of the first and second selector valves, the first outlet of the first selector valve to one of the rod and head end portions of the second jack, the second outlet of the second selector valve to a corresponding one of the rod and head end portions of the first jack, the second outlet of the first selector valve to the first inlet of the third selector valve, the first outlet of the second selector valve to the second inlet of the third selector valve, the first outlet of the third selector valve to the other of the rod and head end portions of the first jack, and the second outlet of the third selector valve to a corresponding other one of the rod and head end portions of the second jack;

control means for selectively moving said main control valve between said first and second positions, said first and third selector valves together between said first and second positions, and said second and third selector valves together between said first and second positions, said control means being connected to said main control valve means and said first, second, and third selector valves, said first and second jacks being movable in unison and in the same direction in response to said third selector valve being at the first position, the main control valve being at one of the first and second positions, and the first and second selector valves being at the first position, and said one of the first and second jacks being movable independently of the other in response to said main control valve being at one of the first and second positions, the third selector valve being at the second position, and one of the first and second selector valves being at the second position;

said first, second and third selector valves being electro-hydraulic valves and said control means including a pivotally movable hand lever and first and second normally open switches, said first and second switches being connected to a source of electrical energy, the third selector valve, and the first and second selector valves, respectively, said first and third selector valves being movable to the second position in response to closing of the first switch and said second and third selector valves being movable to the second position in response to closing of the second switch, said main control valve being movable between the first and second positions in response to pivotal movement of the control lever.

2. A control system, as set forth in claim 1, wherein the first outlet of the first selector valve is connected to the rod end portion of the second jack, the second outlet of the second selector valve is connected to the rod end portion of the first jack, the first outlet of the third selector valve is connected to the head end portion of the first jack, and the second outlet of the third selector valve is connected to the head end portion of the second jack.

3. A control system, as set forth in claim 1, wherein said first and second jacks each have a piston of a preselected diameter, said piston diameters being substantially equal in magnitude, said first and second forks moving in unison in the same direction and at equal speeds in response to the main control valve being at one of the first and second positions and the first, second, and third selector valves being at the first position.

4. A control system, as set forth in claim 1, wherein said second fork is movable relative to the first fork in response to the main control valve being at one of the first and second positions, the first selector valve being at the first position, the second selector valve being at the second position, and the third selector valve being at the second position.

5. A control system, as set forth in claim 4, wherein said first fork is movable relative to the second fork in response to the main control valve being at one of the first and second positions, the second selector valve being at the first position, the first selector valve being at the second position, and the third selector valve being at the second position.

6. A control system, as set forth in claim 1, wherein said first and second switches are mounted on the control lever.

7. A control system, as set forth in claim 1, including:

a first conductor connected to and between the first switch and the first selector valve;

a second conductor connected to and between the second switch and the second selector valve;

a branch conductor connecting the first and second conductors to the third selector valve;

a first diode connected in the first conductor between the first selector valve and the branch conductor; and a second diode connected in the second conductor between the second selector valve and the branch conductor.

8. A control system for selectively moving first and second load engaging forks along a carriage frame, comprising:

a first fluid operated jack connected to the first load engaging fork and the carriage frame;

a second fluid operated jack connected to the second load engaging fork and the carriage frame, said first and second fluid operated jacks each having head and rod end portions and being adapted to move the first and second load engaging forks, respectively, along the carriage frame;

a reservoir;

a source of pressurized fluid flow connected to said reservoir;

a main control valve having first and second positions and being movable between said first and second positions, said main control valve having first and second outlets and being connected to the source of pressurized fluid flow and said reservoir, said main control valve connecting the source to the first outlet and the reservoir to the second outlet at the first position, and the reservoir to the first outlet and the source to the second outlet at the second position;

a first selector valve having first and second positions and being movable between said first and second positions, said first selector valve having first and second inlets and first and second outlets, said first selector valve first inlet being connected to the first selector valve second outlet and said first selector valve second inlet being connected to the first selector valve first outlet at the first position of the first selector valve, said first and second inlets and outlets of the first selector valve being blocked from each other at the second position of the first selector valve;

a second selector valve having first and second positions and being movable between said first and second positions, said second selector valve having first and second inlets and first and second outlets, said second selector valve first inlet being connected to the first selector valve second outlet and said second selector valve second inlet being connected to the second selector valve first outlet at the first position of the second selector valve, said first and second inlets and outlets of the second selector valve being blocked from each other at the second position of the second selector valve;

a third selector valve having first and second positions and being movable between said first and second positions, said third selector valve having first and second inlets and first and second outlets, said third selector valve first and second inlets being blocked from the third selector valve first and second outlets at the first position of the third selector valve, said the third selector valve first and second outlets being connected to each other at the first position of the third selector valve, and said third selector valve first inlet being connected to the third selector valve second outlet and said third selector valve second inlet being connected to the third selector valve first outlet at the second position of the third selector valve;

means for connecting the first outlet of the main control valve to the first inlet of the first and second selector valves, the second outlet of the main control valve to the second inlet of the first and second selector valves, the first outlet of the first selector valve to one of the rod and head end portions of the second jack, the second outlet of the second selector valve to a corresponding one of the rod and head end portions of the first jack, the second outlet of the first selector valve to the first inlet of the third selector valve, the first outlet of the second selector valve to the second inlet of the third selector valve, the first outlet of the third selector valve to the other of the rod and head end portions of the first jack, and the second outlet of the third selector valve to a corresponding other one of the rod and head end portions of the second jack;

control means for selectively moving said main control valve between said first and second positions, said first and third selector valves together between said first and second positions, and said second and third selector valves together between said first and second positions, said control means being connected to said main control valve means and said first, second, and third selector valves, said first and second jacks being movable in unison and in the same direction in response to the third selector valve being at the first position, the main control valve being at one of the first and second positions, and the first and second selector valves being at the first position, and said one of the first and second jacks being movable independently of the other in response to said main control valve being at one of the first and second positions, the third selector valve being at the second position, and one of the first and second selector valves being at the second position.

9. A control system, as set forth in claim 8, including spring means for normally biasing said first, second and third selector valves to the first position.

10. A control system for selectively moving first and second load engaging forks along a carriage frame, comprising:

first and second fluid operated jacks each having a housing, an extensible piston rod assembly, and head and rod end portions, said first jack being connected to and between the first fork and the carriage frame and said second jack being connected to and between the second fork and the carriage frame, said first and second forks being movable along the carriage frame in response to extension and retraction of the piston rod assembly;

a reservoir;

a source of pressurized fluid flow connected to said reservoir; and valve means for directing fluid flow from the fluid source to a selected one of the rod and head end portions of one of the first and second jacks, exhausted fluid flow from the other end portion of the one jack to the corresponding one of the rod and head end portions of the other jack, and fluid flow from the other end portion of the other jack to the reservoir in response to being in a first mode of operation, and for directing fluid flow from the source of pressurized fluid flow to one of the rod and head end portions of a selected one of the first and second jacks and from the other end portion of said selected one jack to the reservoir in response to being in a second mode of operation, said valve means being connected to said first and second jacks, said source, and said reservoir, and being selectively movable between said first and second modes of operation; and control means for selecting one of the first and second modes of operation and moving said valve means to said selected one of the first and second modes of operation, said control means being connected to said valve means, said first and second forks being movable in unison in the same direction and at substantially the same speed in response to said valve means being in said first mode of operation, and one of the first and second forks being movable independently of the other of the first and second forks in response to the valve means being in said second mode of operation.

11. A control system, as set forth in claim 10, wherein said valve means includes first, second and third electrically actuatable selector valves, said first and second selector valves being connected to and between the first and second jacks, respectively, and said source of pressurized fluid flow, said first, second and third selector valves each being movable between first and second positions, said first, second and third selector valves being at the first position in the first mode of operation, and one of the first and second selector valves being at the first position and the other of said first and second selector valves and the third selector valve being at the second position in the second mode of operation.

12. A control system, as set forth in claim 11, wherein said first and second selector valves being adapted to deliver pressurized fluid flow from said source of pressurized fluid flow to the rod end portion of the first and second jacks, respectively, at the first position of the first and second selector valves, and said third selector valve being adapted to deliver fluid flow between the head ends of said first and second jacks at the first position of the third selector valve.

13. A control system, as set forth in claim 11, wherein said third selector valve being adapted to direct pressurized fluid flow from the first selector valve to the head end portion of the second jack at the second position of the third selector valve, and said third selector valve being adapted to direct pressurized fluid flow from the second selector valve to the head end portion of said first jack at the second position of said third selector valve.

14. A control system, as set forth in claim 11, wherein said valve means includes a main control valve connected to said source of pressurized fluid flow, said reservoir, and said first and second selector valves, said main control valve being movable between a first position at which pressurized fluid.

15. A lift mast assembly having a pair of spaced apart uprights; comprising:

a carriage assembly having a carriage frame and first and second forks slidably connected to said carriage frame and movable in directions transverse the pair of uprights, said carriage frame being movably connected to the pair of uprights and elevationally movable along the pair of uprights;

first and second fluid operated jacks each having a housing, an extensible piston rod assembly, and head and rod end portions, said first jack being connected to and between the first fork and the carriage frame and said second jack being connected to and between the second fork and the carriage frame, said first and second forks being transversely movable along the carriage frame in response to extension and retraction of the piston rod assembly;

a reservoir;

a source of pressurized fluid flow connected to said reservoir; and valve means for directing fluid flow from the fluid source to a selected one of the rod and head end portions of one of the first and second jacks, for directing exhausted fluid flow from the other end portion of the one jack to the same one of the rod and head end portions of the other jack and for directing fluid flow from the other end portion of the other jack to the reservoir in response to being in a first mode of operation, and for directing fluid flow from the source of pressurized fluid flow to one of the rod and head end portions of a selected one of the first and second jacks and from the other end portion of said selected one jack to the reservoir in response to being in a second mode of operation; and control means for selecting one of the first and second modes of operation, said control means being connected to said valve means.

16. A lift mast assembly, as set forth in claim 15, wherein said first and second forks are movable in unison in the same direction and at substantially the same speed in response to said valve means being in said first mode of operation, one of the first and second forks being movable independently of the other of the first and second forks in response to the valve means being in said second mode of operation.

17. A lift mast assembly, as set forth in claim 16, wherein said valve means includes first, second and third electrically actuatable selector valves, said first and second selector valves being connected to and between the first and second jacks, respectively, and said source of pressurized fluid flow, said first, second and third selector valves each being movable between first and second positions, said first, second and third selector valves being at the first position in the first mode of operation, and one of the first and second selector valves being at the first position and the other of said first and second selector valves and the third selector valve being at the second position in the second mode of operation.

18. A lift mast assembly, as set forth in claim 17, wherein said first and second selector valves being adapted to deliver pressurized fluid flow from said source of pressurized fluid flow to the rod end portion of the first and second jacks, respectively, at the first position of the first and second selector valves, and said third selector valve being adapted to deliver fluid flow between the head ends of said first and second jacks at the first position of the third selector valve.

19. A lift mast assembly, as set forth in claim 17, wherein said third selector valve being adapted to direct pressurized fluid flow from the first selector valve to the head end portion of the second jack at the second position of the third selector valve, and said third selector valve being adapted to direct pressurized fluid flow from the second selector valve to the head end portion of said first jack at the second position of said third selector valve.

20. A lift mast assembly, as set forth in claim 17, wherein said valve means includes a main control valve connected to said source of pressurized fluid flow, said reservoir, and said first and second selector valves, said main control valve being movable between a first position at which pressurized fluid flow is directed in a first direction to said first and second selector valves and a second position at which fluid flow is directed in a second direction to said first and second selector valves, said second selector valve being adapted to deliver fluid flow directed by the main control valve to the rod end portion of the first jack at the first position of the main control valve and said first selector valve being adapted to deliver fluid flow directed by the main control valve to the rod end portion of the second jack at the second position of the main control valve.

21. A lift mast assembly, as set forth in claim 15, wherein said control means includes a switch means connected to said valve means and actuatable for placing said valve means in said second mode of operation.

22. A lift mast assembly, as set forth in claim 15, wherein said valve means is normally in the first mode of operation.

23. A lift mast assembly, as set forth in claim 20, wherein said control means includes first and second electrical switches connected to said third selector valve and said first and second selector valves, respectively, said first and second switches being movable between a normally open position and a closed position, said first and third selector valves being movable from said first position to said second position in response to the closing of said first switch and said second and third selector valves being movable from the first position to the second position in response to a closing of the second switch.

24. A lift mast assembly, as set forth in claim 23, wherein said control means includes a control lever means for moving said main control valve between said first and second positions, said first and second switches being mounted on the control lever means.

* * * * *

UNITED STATES PATENT AND TRADEMARK OFFICE

CERTIFICATE OF CORRECTION

PATENT NO. : 5,088,880

DATED : February 18, 1992

INVENTOR(S) : Jesse L. Field, Jr.

It is certified that error appears in the above-identified patent and that said Letters Patent is hereby corrected as shown below:

Claim 8, column 14, line 26, after "position," delete "and".

Claim 8, column 14, line 28, after "to" delete "said" and insert --the--.

Claim 10, column 14, line 64, after "being" delete "in" and insert --at--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*